US006325003B1

(12) United States Patent
Ashworth et al.

(10) Patent No.: US 6,325,003 B1
(45) **Date of Patent: *Dec. 4, 2001**

(54) LOW NITROGEN OXIDES EMISSIONS FROM CARBONACEOUS FUEL COMBUSTION USING THREE STAGES OF OXIDATION

(75) Inventors: Robert Ashworth, Wooster, OH (US); Frederick J. Murrell, Bradenton, FL (US); Edward A. Zawadzki, Lexington, KY (US)

(73) Assignee: Clearstack Combustion Corporation, Wooster, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/590,713

(22) Filed: Jun. 8, 2000

Related U.S. Application Data

(63) Continuation-in-part of application No. 09/243,501, filed on Feb. 3, 1999, now Pat. No. 6,085,674.

(60) Provisional application No. 60/140,127, filed on Jun. 21, 1999.

(51) Int. Cl.[7] ..... F23B 7/00; F23L 15/00; F23J 15/00

(52) U.S. Cl. ..... 110/345; 110/214; 110/302; 110/308; 110/347; 110/348; 431/10; 431/11

(58) Field of Search ..... 110/203, 208, 110/210, 212, 214, 215, 229, 302, 303, 305, 308, 342, 345, 347, 348; 431/2, 4, 5, 8, 9, 10, 11, 12, 161, 163, 164, 165, 166, 167, 182, 183, 190

(56) References Cited

U.S. PATENT DOCUMENTS

| | | | | |
|---|---|---|---|---|
| 2,925,069 | | 2/1960 | Terpe . | |
| 3,727,562 | | 4/1973 | Bauer . | |
| 3,955,512 | | 5/1976 | Martin et al. . | |
| 4,343,606 | | 8/1982 | Blair et al. . | |
| 4,423,702 | | 1/1984 | Ashworth et al. . | |
| 4,427,362 | | 1/1984 | Dykema . | |
| 4,501,204 | * | 2/1985 | McCartney et al. | 110/302 X |
| 4,685,404 | | 8/1987 | Sheppard et al. . | |
| 4,765,258 | | 8/1988 | Zauderer . | |
| 4,971,552 | * | 11/1990 | Fukuda et al. | 431/9 X |
| 5,246,364 | * | 9/1993 | Landreth et al. | 110/345 X |
| 5,284,438 | * | 2/1994 | McGill et al. | 431/9 |
| 5,458,659 | | 10/1995 | Ashworth . | |
| 5,937,772 | * | 8/1999 | Khinkis et al. | 110/345 |

* cited by examiner

*Primary Examiner*—Ira S. Lazarus
*Assistant Examiner*—Ljiljana V. Ciric
(74) *Attorney, Agent, or Firm*—Buchanan Ingersoll, P.C.

(57) ABSTRACT

A method for reducing $NO_x$ emissions from the combustion of carbonaceous fuels using two sequential stages of partial oxidation followed by a final oxidation stage. In the first stage, substoichiometric air condition of about 0.55 to 0.75 is used in a plug flow fashion, while second stage combustion is performed at a stoichiometric ratio of about 0.80 to 0.99. As the second stage combustion products are cooled by radiant heat transfer to the boiler furnace walls, overfire air is added to produce an stoichiometric ratio of about 1.05 to 1.25 to complete the combustion process. In this manner, the formation of thermal $NO_x$ is reduced.

18 Claims, 3 Drawing Sheets

LOW NITROGEN OXIDES EMISSIONS FROM CARBONACEOUS FUEL COMBUSTION USING THREE STAGES OF OXIDATION

RELATED APPLICATION

This application is a continuation in part of application Ser. No. 09/243,501, filed Feb. 3, 1999 and now U.S. Pat. No. 6,085,674; and is related to Provisional Patent Application Serial No. 60/140,127 filed Jun. 21, 1999.

BACKGROUND OF THE INVENTION

1. Field of the Invention

This invention relates to a method that provides for reduction of nitrogen oxides from the combustion of carbonaceous fuels. More particularly, it refers to a combustion technique that uses two sequential stages of partial oxidation followed by a final stage of complete oxidation that can be easily retrofitted to existing pulverized coal-fired and oil-fired utility boilers.

2. Description of the Prior Art

There are several patents that describe staged combustion techniques to reduce nitrogen oxides emissions from the combustion of fuels containing nitrogen. U.S. Pat. No. 3,727,562 describes a three stage process for reducing nitrogen oxides ($NO_x$) emissions wherein the first stage of combustion is operated with a deficiency of air and the unburned fuel from this stage is separated and burned in a second zone with excess air and then the second stage gases are burned in a third excess air stage. U.S. Pat. No. 4,343,606 describes a multi-stage combustion process wherein fuel gas produced in a first stage partial oxidation zone, operated at a stoichiometric air to fuel ratio of 0.50 to 0.625, followed by a second stage of oxidation wherein it is operated at an air to fuel stoichiometric ratio of 1.0 or slightly greater. Following this, additional air is added to insure that the fuel is completely oxidized. While these methods accomplish their intended purposes, they do not provide the $NO_x$ reduction required under current regulations, which reductions are achievable with the present invention.

The Clean Air Act Amendments of 1990 set $NO_x$ emission limits for coal-fired utility boilers, to be met in the year 2000, that range from 0.40 to 0.86 lb $NO_x/10^6$ Btu depending on boiler type. However, the U.S. EPA has promulgated more stringent regulations for Eastern and Mid-Western States that will limit nitrogen oxides emissions for all types of coal-fired boilers during the ozone season (May through September) to 0.15 lb $NO_x/10^6$ Btu. The combustion technologies commercially available today cannot meet this limit.

The only technology available to the carbonaceous fuel fired utility boiler industry that will guarantee this low level of $NO_x$ emissions is the Selective Catalytic Reduction (SCR) technology. The SCR method uses ammonia addition and a downstream catalyst to destroy the $NO_x$ produced in the coal combustion process. This approach is expensive both from capital and operating cost perspectives.

Further, arsenic concentrations (>10 ppmw) in the coal can also poison the catalyst, shortening its life. In addition, ammonium sulfites/sulfates and calcium sulfates from the combustion process can blind the catalyst, reducing catalyst effectiveness. Still further any ammonia that passes through the catalyst unconverted (ammonia slip) will enter the atmosphere, react with air born sulfur dioxide and nitrogen dioxide to form fine particulate ($PM_{2.5}$). This is an environmental debit for SCR technology because the U.S. EPA regulates emissions of fine particulate. Very fine particles are not filtered out by nose hairs (particles less than 6 microns) and enter the lungs.

It would therefore be very advantageous to have an improved combustion process that will yield nitrogen oxide emissions, when firing carbonaceous nitrogen containing fuels, of 0.15 lb $NO_x/10^6$ Btu or less. In such a system, catalyst is not used; therefore, coal products of combustion have no effect on the process other than that of normal combustion processes, making staged combustion is a more reliable technology than SCR. Further, ammonia is not used and fine particulate emissions will not increase.

Such a system will also provide a much lower cost per ton of $NO_x$ reduced compared to SCR, providing the electric utility industry with an economical technology to meet the level of nitrogen oxides emissions to be imposed on Eastern and Mid-Western utilities in the year 2003.

SUMMARY OF THE INVENTION

We have discovered a process using staged combustion techniques that will reduce $NO_x$ emissions to the levels to be imposed on Eastern and Mid-Western utilities by the U.S. EPA in the year 2003 (<0.15 lb $NO_x/10^6$ Btu). To accomplish this, any existing pulverized coal-fired or oil-fired burners may be used wherein the burner air-to-fuel stoichiometric ratio (SR) is operated in the range of about 0.55 to 0.75.

Typically, the carbonaceous fuel is fired in a wall-fired or corner-fired boiler furnace in a plug flow fashion under a sub-stoichiometric air condition (SR at about 0.55 to 0.75). The plug flow firing technique creates a high temperature reducing condition that minimizes the $NO_x$ produced from the oxidation of fuel bound nitrogen. Some of the first stage combustion air can be added below the burners. By adding air underneath the burners, the bottom of the furnace is maintained in an excess air condition to preclude the potential of reducing gas corrosion in this part of the furnace. In the second combustion stage, preheated air is introduced into the furnace above the first stage burners, the air rate being set to yield an overall SR in the middle furnace of 0.80 to 0.99. With this technique, the upper middle of the furnace is slightly reducing (oxygen deficient) and the production of thermal $NO_x$ is minimized.

Another alternative for furnaces with multiple rows of burners is to operate the lower level of burners in an excess air condition, (SR of 1.05 to 1.15) with air introduction through the upper rows of burners such that an SR in the first stage of about 0.55 to 0.75 is maintained. This technique will also keep the bottom of the furnace in an oxidizing condition, but will form slightly more $NO_x$.

The products of partial combustion from the second stage of combustion rise up through the boiler furnace and are cooled by radiant heat transfer to the furnace water-walls. When these gases have been cooled down to a range of about 2300° F. to 2700° F., overfire air (OFA) is added to bring the overall SR at this point to a range of approximately 1.05 to 1.25 to complete the combustion process. Thermal $NO_x$ production is greatly reduced in this OFA zone because the temperatures are relatively low and $NO_x$ production reactions are not favored. This method of the present invention can be retro-fitted to any existing boiler, furnace and can also be implemented during the construction of new boiler furnaces.

BRIEF DESCRIPTION OF THE DRAWINGS

Other objects, features and advantages will become apparent in reading the following detailed description in light of the various figures, which are shown by way of example only, wherein.

DETAILED DESCRIPTION OF THE INVENTION

To achieve deep levels of $NO_x$ reduction using staged combustion for the firing of carbonaceous fuels requires that the stoichiometric air-to-fuel ratio be less than 1.0 during the process, until the products of combustion are cool enough to preclude thermal $NO_x$ production. We have discovered a process using such a staged combustion technique that will reduce $NO_x$ emissions to the U. S. EPA required limit (<0.15 lb $NO_x/10^6$ Btu) starting in year 2003.

To implement this staged combustion technique, any existing carbonaceous fuel-fired burner may be modified wherein the air to fuel stoichiometric ratio (SR) can be operated in a range of about 0.55 to 0.75. Steam may also be added with the air/coal stream in the first stage of combustion (burner) to improve carbon burnout, as described in U.S. Pat. No. 5,458,659.

Figure 1:
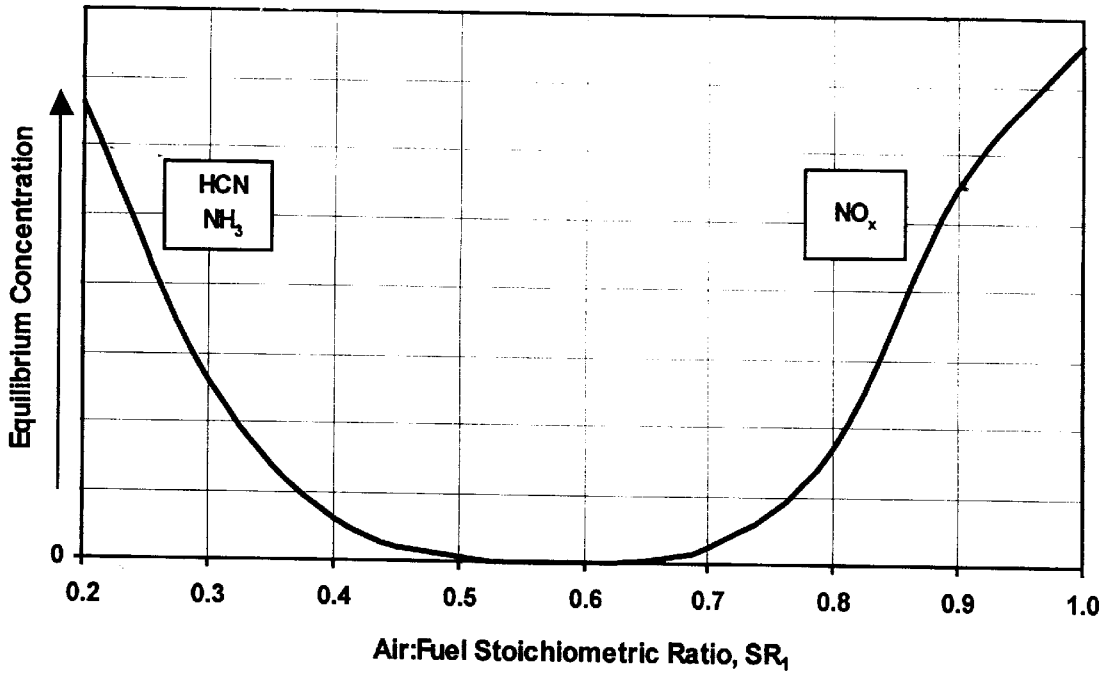
FIG. 1 is a graph showing the NO equilibria as it a function of the first stage air-to-fuel stoichiometric ratio.

The carbonaceous fuel is fired in the existing burners under a sub-stoichiometric air condition (first stage) that reduces the $NO_x$ produced from fuel bound nitrogen oxidation. The first stage temperatures will be determined by the fuel analysis, rate of steam addition, the temperature of the pre-heated air, air-to-fuel ratio, and the heat removal designed into the combustor. The first stage temperatures will typically be in the range of 2600° F. to 3000° F. The SR in this stage will typically be in the range of 0.55 to 0.75. The first stage of combustion should preferably have a residence time of about 0.1 second to 0.3 second to provide for low production of ammonia and hydrogen cyanide that are $NO_x$ precursors under high temperature and oxidizing conditions and to minimize $NO_x$ formation in the first stage see FIG. 1.

In the second stage, preheated combustion air is introduced into the rising first stage fuel gas. Second stage combustion air is added at a rate to yield an overall SR at this point in the range of about 0.80 to 0.99.

Figure 2:
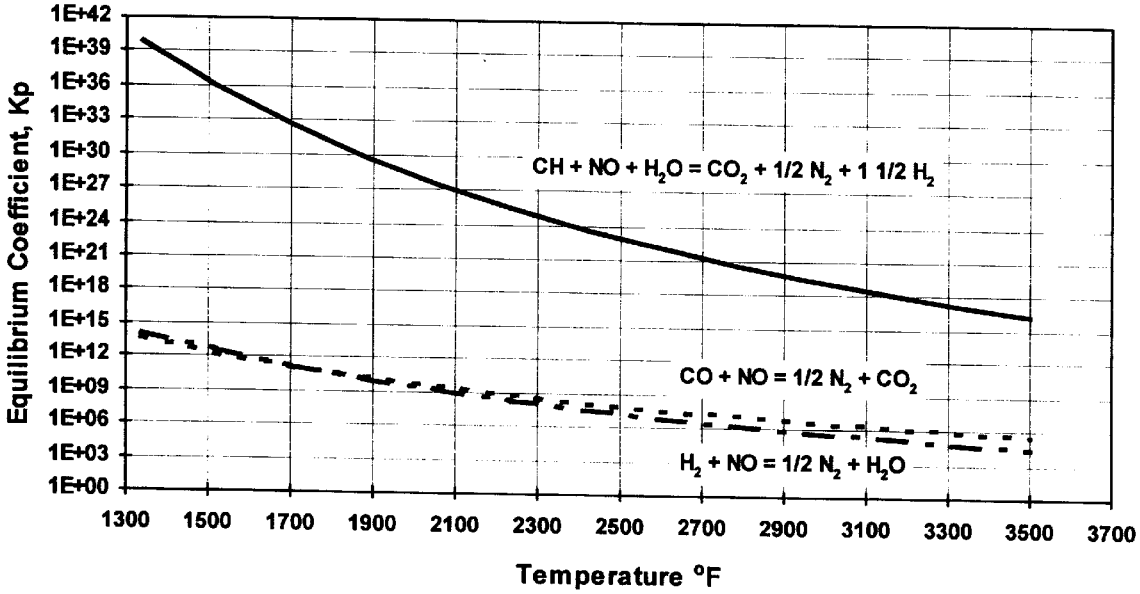
FIG. 2 is a graph showing the second stage NO reducing reactions as a function of temperature.

The SR used in this second stage is similar to the SR used in conventional return technology, wherein fuel is added to combustion flue gases in the hot part of the furnace above, and with some separation from, the conventional burners to reduce the furnace SR at the reburn fuel injection point from the 1.10 to 1.20 range supplied by the burners entering the zone, down to an SR of about 0.90. The nominal 0.90 SR provides a reducing gas condition that converts nitric oxide (NO) that was formed in the excess air burner flames, back to atmospheric or diatomic nitrogen ($N_2$). With the staged combustion technique of the present invention, the $NO_x$ and $NO_x$ precursor compounds exiting the first stage (typically an SR=0.60) will be much lower than that of conventional burners that yield an overall excess air condition (SR>1.0). Since $NO_x$ production is greatly influenced by the oxygen partial pressure in the combustion zone, the higher the oxygen concentration, the higher the $NO_x$ production. By firing the coal in the first stage at an SR of 0.60 and by adding air in the second stage maintaining an SR of about 0.90, minimal $NO_x$ is formed because the reducing gases produced have the tendency to convert any $NO_x$ that has formed to $N_2$ (second stage operated like reburn technology), see reactions below and in FIG. 2. The hydrocarbon radicals ($CH_x$), carbon monoxide (CO) and hydrogen ($H_2$) produced in the first two stages are favored to convert NO to $N_2$ in accord with the following example overall simplified reaction examples:

$$NO+[CH]\gamma\tfrac{1}{2}N_2+CO+\tfrac{1}{2}H_2,$$

$$NO+CO\gamma\tfrac{1}{2}N_2+CO_2 \text{ and}$$

$$NO+H_2\gamma\tfrac{1}{2}N_2+H_2O.$$

Figure 3:
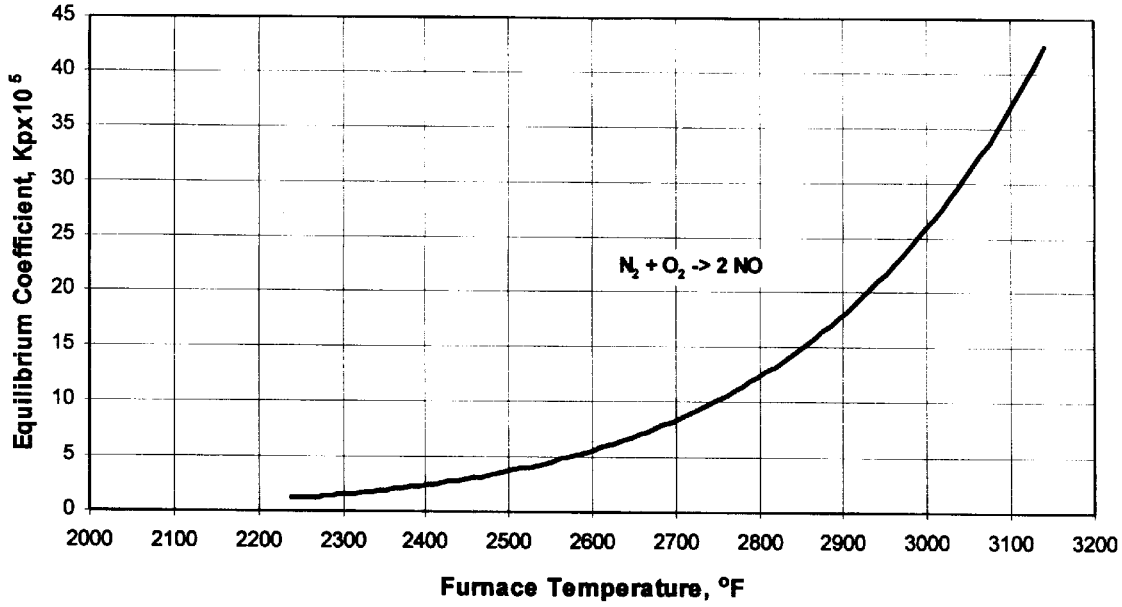
FIG. 3 is a graph showing the thermal NO equilibria as it varies with temperature.

The partial combustion gaseous products from the second stage rise up through the boiler furnace and are cooled by radiant and convective heat transfer to the furnace waterwalls. When the flue gases have cooled down to a range of about 2300° F. to 2700° F., overfire air (OFA) is added to complete the combustion process. $NO_x$ production is greatly reduced in the OFA zone because the temperatures are low. Thermal $NO_x$ reactions are less favored than under higher furnace temperature conditions See FIG. 3. For example, the equilibrium constant for the thermal $NO_x$ reaction ($N_2+O_2\gamma 2$ NO) at 2400° F. is about one-tenth of the equilibrium constant at 3000° F.

Figure 4:
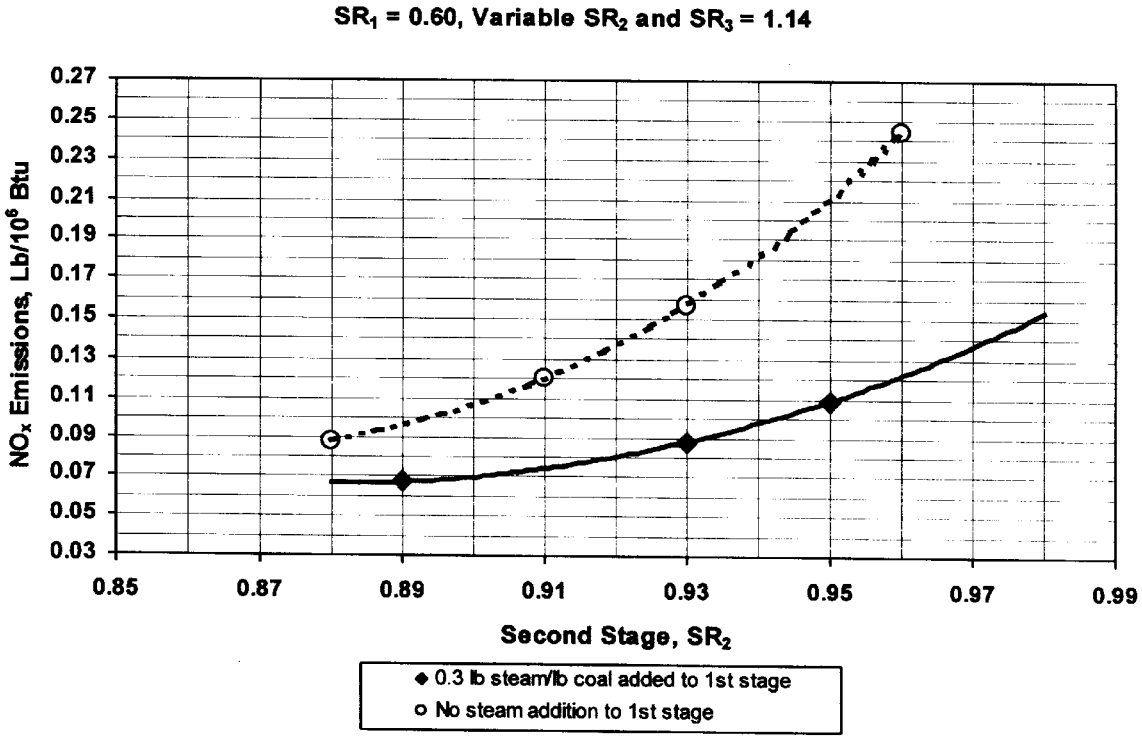
FIG. 4 is a graph showing the kinetic modeling results for constant first and second stage air-to-fuel ratios with varying third stage air-to-fuel ratios.

One dimensional flame kinetic modeling was completed for the three-stage technique wherein the first stage $SR_1$ was held at a value of 0.60, optimum for low $NO_x$ production. The second stage $SR_2$ was varied and the third stage $SR_3$ was held at a constant 1.14. The kinetic modeling $NO_x$ emission predictions, based on these parameters, are shown in FIG. 4. The modeling showed that this technique could reduce NO. emissions to as low as 0.07 lb $NO_x/10^6$ Btu of coal fired.

Throughout the following detailed process description, the same reference numerals refer to the same elements in the various figures.

Figure 5:
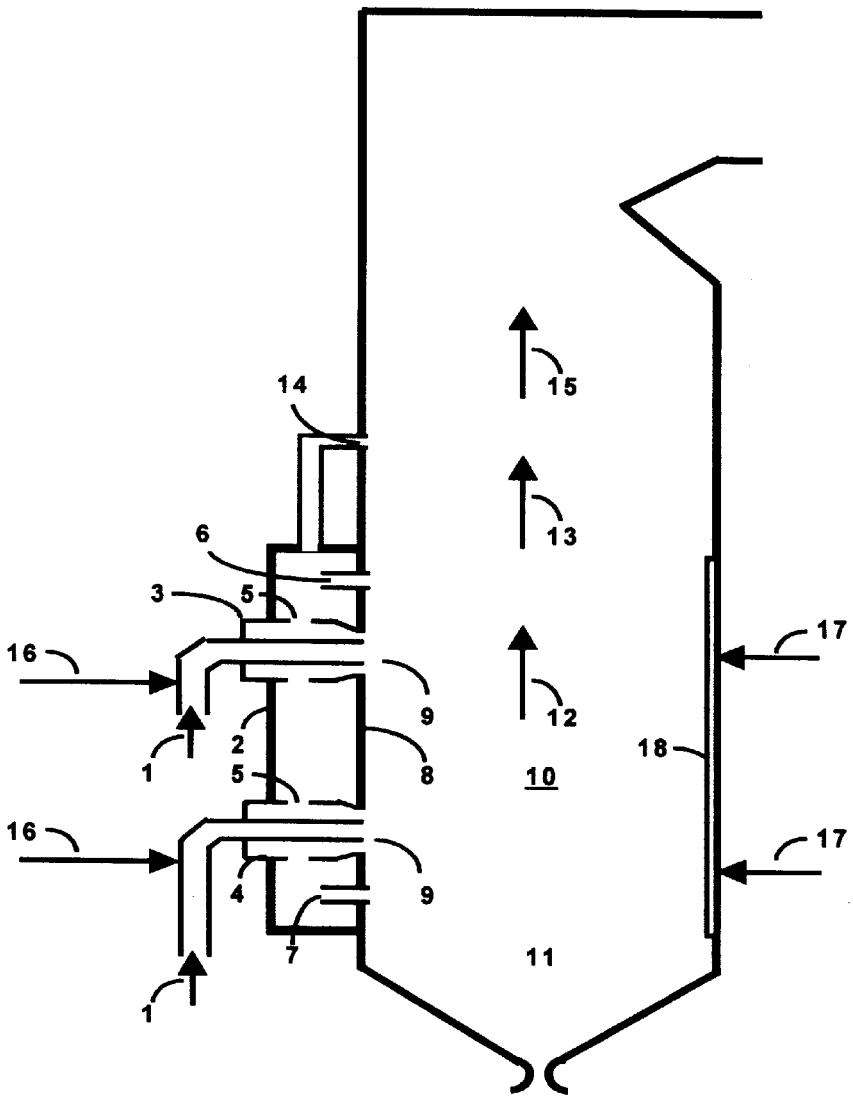
FIG. 5 is a pictorial description for the staged combustion process applied to an electric utility boiler furnace.

A typical example of the process of the present invention is shown schematically in FIG. 5. It will be understood by those skilled in the art that certain variations from this schematic could be made with such variations still being within the context of the present invention. In the embodiment shown in FIG. 5, burners 3 and 4 are located on the front wall 8 of a wall-fired pulverized coal-fired (for example) furnace 10 passing through the windbox 2. Pipes 1 to each of the burners 3 and 4 receive the pulverized coal, with the carrier air, from a pulverizer (not shown), the coal being ignited at the furnace entries 9. Controlled partial oxidation of the coal takes place in the lower to middle part of the furnace 12 by regulation of the preheated (400° to 700° F.) first stage airflows 5. Coned entries 19 are used to create plug flow conditions that yield high flame zone temperatures under deep sub-stoichiometric air-to-fuel conditions. The air-to-fuel stoichiometric ratio (SR) in these burners 3 and 4 is maintained at an SR of 0.55 to 0.75, and most preferably at about 0.60. In an alternative embodiment, the injection of steam or water 16 into burners 3 and 4 may be used, adding the steam or water to yield a 0.1 to 0.3 steam- or water-to-fuel-weight ratio to enhance carbon burnout ($C_2O\ \gamma CO_2+H_2O$). To minimize the production of hydrogen cyanide (HCN) and ammonia ($NH_3$) that are $NO_x$ precursors at high temperatures under an excess air condition, the residence time in the first stage combustion zone should be in the range of about at least 0.1 second to 0.3 second. The preheated air for the second stage of combustion is added into the furnace 10 above the coal burners 3 and 4 through injectors 6.

A small amount of air is added below the coal burners 3 and 4, though injectors 7 to create an oxidizing condition in the bottom part of the furnace 11. Another alternative for maintaining the bottom of the furnace in an oxidizing condition for furnaces with multiple rows of burners is to operate the lower level of burners 4 in an excess air condition, (SR of about 1.05 to 1.15) with the upper rows of burners 5 operated at air rates to yield an overall SR for this zone that is in the range of about 0.55 to 0.75. Further, in the first stage combustion zone, air may be added through furnace wall injectors 17 in an upward direction to form an air curtain over the furnace waterwalls to protect the walls from potential corrosion due to the reducing condition will yield hydrogen sulfide that may attack the metal tubes. Also, to protect the furnace tubes in this zone, a thin layer of corrosion resistant refractory 18 may be added to overlay the tubes.

After the partial oxidation gases from the first stage 12 have had 0.1 second to 0.3 second residence time in the furnace, air is added to create a second stage zone that is still slightly reducing, maintaining a 0.80 to 0.99 SR in this zone. Partial combustion gas products from the second stage of combustion, 13, pass through the radiant section of the furnace 10 and are cooled to a temperature of 2400° F. to 2700° F., wherein the gas has been maintained in a reducing condition for about 0.25 second to 0.50 second or greater. At this point overfire air (OFA) is introduced into the furnace at inlet 14 forming a third stage combustion technique to complete the combustion process, air being added to bring the SR in this zone to about 1.05 to 1.25. OFA injection may be accomplished through any commercially available design to provide for intimate and rapid mixing of the air with the furnace gases so as to provide near complete combustion of the fuel components in the second stage gas stream. Since air is being added after the second stage gas has been cooled, the flame temperatures in the OFA combustion zone are fairly low and there is a minimal production of thermal $NO_x$. The flue gases 15, from the point of OFA injection 14 until entering the furnace superheater/reheater area, should have a residence time of at least about 0.25 second and more preferably 0.50 second or greater.

Figure 6:
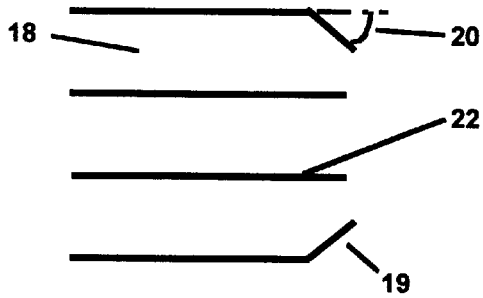
FIG. 6 shows a preferred embodiment for the burner secondary air entry design.

Although any first stage burner combustion techniques could be used, the first stage combustion technique shown in FIG. 6 is designed to introduce burner 3 and 4 burner air through a concentric pipe annulus 13 with an exit cone 19 that surrounds the inner coal-primary air, the terminal end of which forms the entry 9. The cone angle 20, measured from the tertiary air pipe wall 21 into the furnace 10, should be in the range of about 25° to 50° and should be designed in a way to provide for rapid plug flow mixing of the coal and air flowing through fuel pipe 22 as it exits at furnace entry 9 with the preheated (400 to 700° F.) combustion air flowing through tertiary air annulus 23. The air rate is controlled to bring the overall SR in the first stage to 0.55 to 0.75, and further is designed to provide an air entry velocity in the range of 50 ft/sec to 100 ft/sec. This provides for a high temperature reducing zone that favors minimal $NO_x$, hydrogen cyanide ($NO_x$ precursor) and ammonia ($NO_x$ precursor) production.

While specific embodiments of the invention have been described in detail, it will be appreciated by those skilled in the art that various modifications and alterations would be developed in light of the overall teachings of the disclosure. For example, any type of carbonaceous fuel such as one or more fuels from of the class consisting of anthracite, bituminous, sub-bituminous and lignitic coals; tar and emulsions thereof, bitumen and emulsions thereof, petroleum coke, petroleum oils and emulsions thereof, water and/or oil slurries of coal, paper mill sludge solids, sewage sludge solids, and combinations and mixtures thereof. Accordingly, the particular arrangements disclosed are meant to be illustrative only and not limiting as to the scope of the invention which is to be given the full breadth of the appended claims and in any and all equivalents thereof.

What is claimed is:

1. A method for reducing nitrogen oxide ($NO_x$) emissions formed during the combustion of a carbonaceous fuel, said method comprising the steps of:

a) introducing a carbonaceous fuel containing fuel-bound nitrogen into any carbonaceous fuel burner, wherein primary carrier air mixed with a carbonaceous fuel and preheated secondary air at a temperature in a range of about 400° F. to 700° F. is added in a first stage to produce a fuel gas at a stoichiometric air-to-fuel ratio in a range of about 0.55 to 0.75;

b) introducing the fuel gas from the first stage into a second stage of partial oxidation in a boiler furnace by introducing preheated tertiary air into the fuel gas to yield an overall stoichiometric air-to-fuel ratio of about 0.80 to 0.99;

c) introducing the fuel gas from the second stage of partial oxidation in the boiler furnace, the fuel gas flowing through a radiant section of the boiler furnace to produce a flue gas; and d) introducing the gas into a third stage of oxidation wherein preheated overfire air is introduced into the boiler furnace to substantially complete combustion.

2. The method according to claim 1, wherein the carbonaceous fuel comprises one or more fuels from the group of the class consisting of anthracite, bituminous, sub-bituminous and lignitic coals, tar and emulsions thereof, bitumen and emulsions thereof, petroleum coke, petroleum and emulsions thereof, water and/or oil slurries of coal, paper mill sludge solids, sewage sludge solids, and combinations and mixtures thereof.

3. The method according to claim 1, further comprising the step of adding steam or water with the carbonaceous fuel, primary air, or secondary air to yield a 0.1 to 0.3 steam-to-fuel or water-to-fuel weight ratio.

4. The method according to claim 1, wherein the fuel gas has a residence time in the first stage of about 0.1 second to 0.3 second.

5. The method according to claim 1, wherein the fuel and the primary carrier air and the secondary air are mixed using plug flow by introducing preheated secondary air through a concentric pipe in an outer annulus that is coned inward to an outlet of a central first stage carbonaceous fuel pipe entering the boiler furnace, a cone angle from an axial plane of the pipe wall being in a range of about 25° to 50°.

6. The method according to claim 1, wherein the preheated tertiary air is added at a rate to yield an overall stoichiometric air-to-fuel ratio of about 0.80 to 0.99.

7. The method according to claim 1, wherein the preheated air in the second stage of partial oxidation is added using air injection.

8. The method according to claim 1, wherein the fuel has a residence time in the second stage of at least 0.25 second to 0.50 second.

9. The method according to claim 1, wherein the flue gas from the second stage of partial oxidation is maintained in a reducing atmospheric condition for at least 0.50 seconds.

10. The method according to claim 1, wherein the flue gas from the second stage of partial oxidation is cooled to a temperature of about 2300° F. to 2700° F.

11. The method according to claim 1, wherein preheated air in the third stage of partial oxidation is introduced into the flue gas to complete combustion.

12. The method according to claim 1, wherein preheated air in the third stage of partial oxidation is added into flue gas to establish an air-to-fuel stoichiometric ratio of about 1.05 to 1.25.

13. The method according to claim 1, wherein the flue gas has a residence time in the third stage of at least 0.25 second to 0.50 second.

14. The method according to claim 1, wherein the flue gas from the second stage of partial oxidation is maintained in a reducing atmospheric condition for at least 0.50 seconds.

15. The method according to claim 1, wherein preheated air in the third stage of partial oxidation is added using air injection.

16. The method according to claim 1, wherein the boiler furnace has multiple rows of burners, with a lower row of burners being operated under oxidizing conditions and an upper row of burners being operated under reducing condition such that the overall air to fuel stoichiometric ratio in the first stage is maintained in a range of 0.55 to 0.75.

17. The method according to claim 1, wherein the boiler furnace includes both upper and lower burners and an additional amount of air is introduced below the lower burners to create an oxidizing condition at the bottom of the furnace and an amount of air supplied to the upper burners is adjusted such that the overall air-to-fuel stoichiometric first stage is maintained in a range of 0.55 to 0.75.

18. The method according to claim 1, wherein curtain air is introduced through the boiler furnace walls to maintain an oxidizing air current on the boiler furnace walls.

* * * * *

UNITED STATES PATENT AND TRADEMARK OFFICE

CERTIFICATE OF CORRECTION

PATENT NO. : 6,325,003 B1 
DATED : December 4, 2001
INVENTOR(S) : Robert Ashworth, Frederick J. Murrell and Edward A. Zawadzki It is certified that error appears in the above-identified patent and that said Letters Patent is hereby corrected as shown below:

Column 6,
Line 35, "the fuel gas flowing" should read -- flowing the fuel gas --.

Signed and Sealed this

Thirteenth Day of August, 2002

*Attest:*

*Attesting Officer*

JAMES E. ROGAN
*Director of the United States Patent and Trademark Office*